US008056547B2

(12) United States Patent
Juan

(10) Patent No.: US 8,056,547 B2
(45) Date of Patent: Nov. 15, 2011

(54) PAINTBALL FEEDING DEVICE OF PAINTBALL GUN

(75) Inventor: Chih-Chen Juan, Taichung County (TW)

(73) Assignee: Yongmart Manufacturing Co., Ltd, Taichung County (TW)

( * ) Notice: Subject to any disclaimer, the term of this patent is extended or adjusted under 35 U.S.C. 154(b) by 251 days.

(21) Appl. No.: 12/397,541

(22) Filed: Mar. 4, 2009

(65) Prior Publication Data

US 2010/0212649 A1 Aug. 26, 2010

(51) Int. Cl.
*F41A 9/00* (2006.01)

(52) U.S. Cl. ..... 124/51.1

(58) Field of Classification Search ..... 124/21.1, 124/51.1, 52–53; 221/277; 42/19, 39.5, 42/60

See application file for complete search history.

(56) References Cited

U.S. PATENT DOCUMENTS 2,237,678 A * 4/1941 Lohr et al. ..... 124/66
5,954,042 A * 9/1999 Harvey ..... 124/51.1
6,467,473 B1 * 10/2002 Kostiopoulos ..... 124/51.1

* cited by examiner

*Primary Examiner* — Alvin Hunter
*Assistant Examiner* — Amir Klayman
(74) *Attorney, Agent, or Firm* — Apex Juris, PLLC; Tracy M. Heims

(57) ABSTRACT

A paintball feeding device of a paintball gun includes a container, in which paintballs are received, mounted on the paintball gun. A transporting member is received in the container. The transporting member has ball carrying portions to hold the paintballs. The paintball gun has a frame with a chamber therein, and the frame is provided with an inlet and an outlet on opposite sides thereof to be communicated with the chamber respectively. A driving member is connected to the transporting member for driving the transporting member to have the ball carrying portions entering the chamber via the inlet in sequence and leaving the chamber via the outlet.

10 Claims, 7 Drawing Sheets

PAINTBALL FEEDING DEVICE OF PAINTBALL GUN

BACKGROUND OF THE INVENTION

1. Field of the Invention

The present invention relates generally to a paintball gun, and more particularly to a paintball feeding device of a paintball gun.

2. Description of the Related Art

FIG. 9 shows a conventional paintball gun 80 with a conventional paintball feeding device including a hopper 84 on a top of a frame 82 of the paintball gun 80. Paintballs (not shown) are received in the hopper 84 and may drop into a chamber (not shown) in the frame to be fired through a barrel 86.

Such paintball feeding device has several drawbacks, including:

1. The only reason that the paintballs drop into the chamber is gravity, so the paintball gun is better kept straight. In our experience, the paintballs may have problem to drop into the chamber when the gun tilts in any direction over 45 degrees. However, no one can make sure that he/she will pull the trigger in a game only when the gun is straight. Besides, sometime we have to shoot a higher target or a lower target that the conventional paintball gun may have problem to fire paintballs.

2. The frame is provided with a tube connected to the hopper. Typically, the hopper is bigger to receive a large number of paintballs (the common hoppers in the present market may receive 200 paintballs). A diameter of the tube is only a little greater than a paintball that paintballs may enter the chamber in sequence. It frequently gets jam when paintballs run into the small tube from the big hopper. So, when the shooter finds no paintball is fired, the first thing he/she does is shaking the gun, and usually the jam problem may be fixed.

3. The hopper is on the right top of the gun that will interfere with aim.

4. The hopper makes the paintball gun unlike a real gun.

SUMMARY OF THE INVENTION

The primary objective of the present invention is to provide a paintball gun with a novel paintball feeding device, which has no drawback as the conventional device.

According to the objective of the present invention, a paintball feeding device of a paintball gun includes a container, in which paintballs are received, mounted on the paintball gun. A transporting member is received in the container. The transporting member has ball carrying portions to hold the paintballs. The paintball gun has a frame with a chamber therein, and the frame is provided with an inlet and an outlet on opposite sides thereof to be communicated with the chamber respectively. A driving member is connected to the transporting member for driving the transporting member to have the ball carrying portions entering the chamber via the inlet in sequence and leaving the chamber via the outlet.

DETAILED DESCRIPTION OF THE INVENTION

Figure 1:
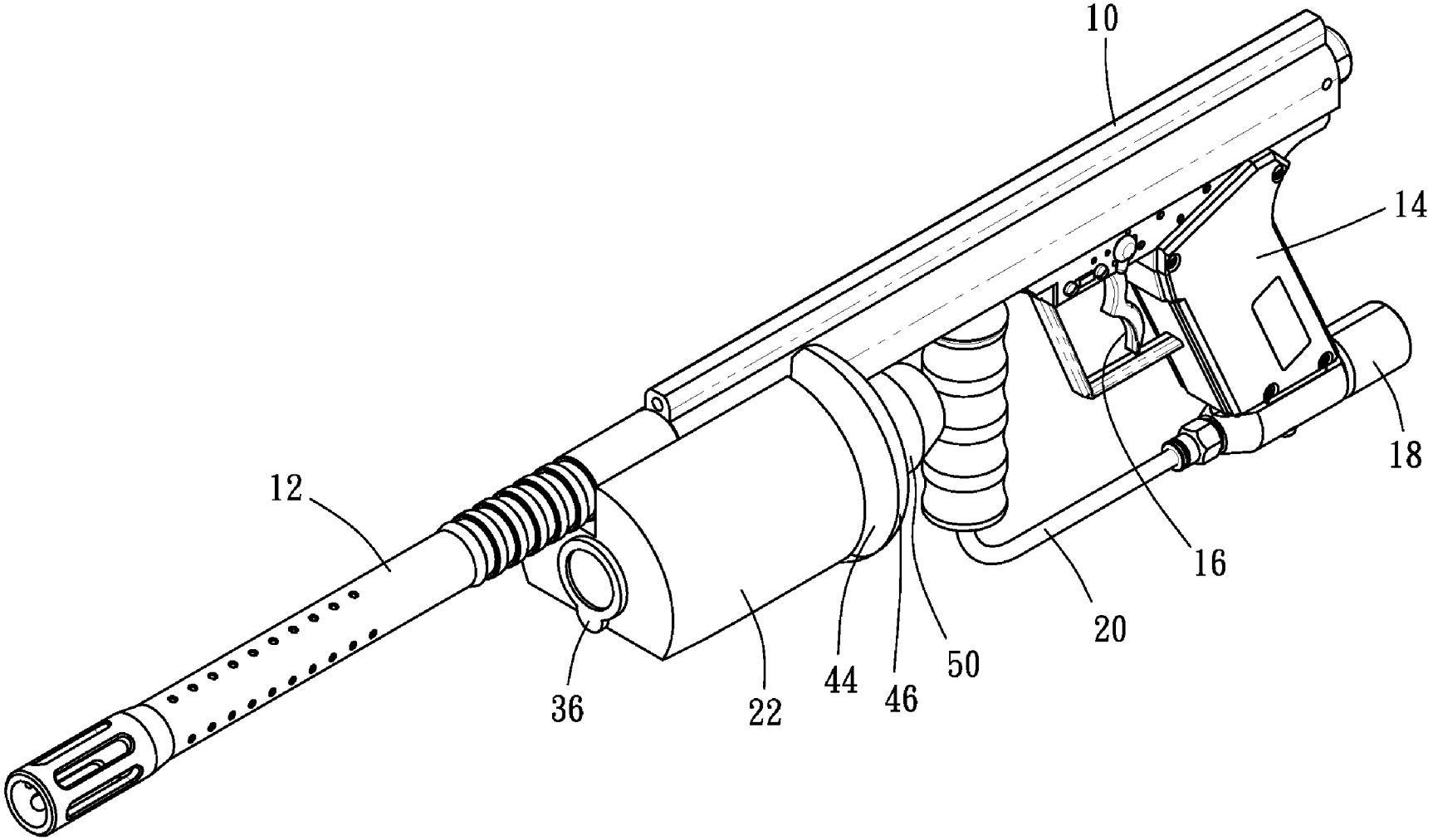
FIG. 1 is a perspective view of a preferred embodiment of the present invention.

As shown in FIG. 1, a paintball gun of the preferred embodiment of the present invention includes a frame 10, a barrel 12 at a front of the frame 10, a handle 14 and a trigger 16 at a bottom of the frame 10. An adaptor 18 is provided at a bottom of the handle 14, and a tube 20 has an end connected to the adaptor 20 and the other end extending into the frame 10 at a position in front of the trigger 16.

Figure 2:
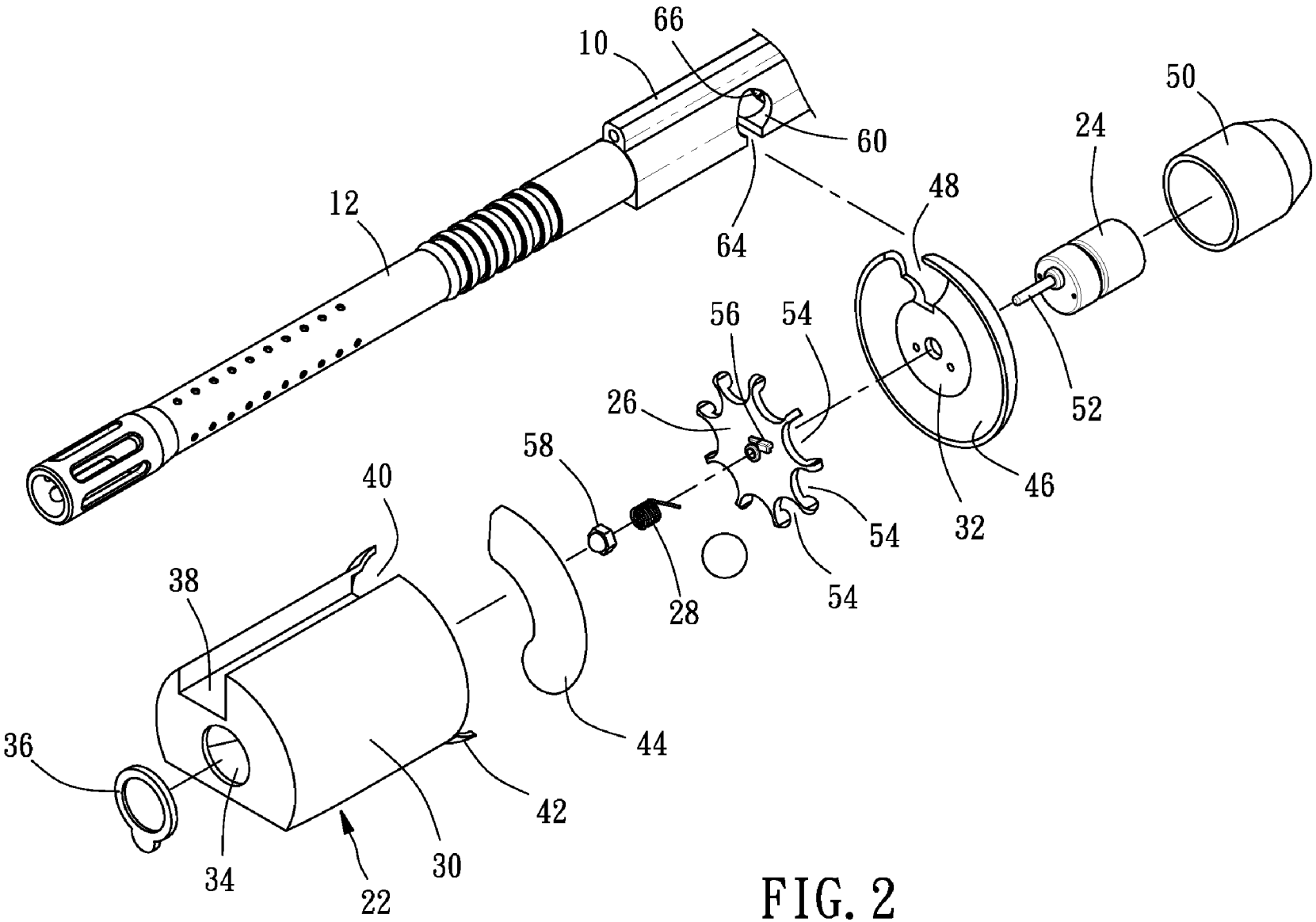
FIG. 2 is an exploded view of the preferred embodiment of the present invention.

The paintball gun of the present invention includes a paintball feeding device mounted at the bottom of the frame 10 in front of the tube 20. As shown in FIG. 2, the paintball feeding device includes a container 22, a driving member 24, a transporting member 26, and an asynchronous driving member 28.

The container 22 includes a box 30 and a base 32. The box 30 has a hole 34 at a front end thereof for an entrance of paintballs, and a lid 36 closing the hole 34. The box 30 has a slot 38 at a top thereof complementary to the frame 10 and the barrel 12, and an opening 40 at a tail end of the slot 38. The box is open at a rear end thereof, and has a curved guiding portion 42 on an edge of the rear end. A semi-circle plate 44 is provided on the rear end of the box 30 and connected to the guiding portion 42. The base 32 is a disk-like member having a curved guiding portion 46 at a circumference thereof, and a gap 48 at a desired position of the guiding portion 46. The gap 48 is complementary to the frame 10. The base 32 is fixed to the rear end of the box 30 that the guiding portion 42 and the plate 44 of the box 30 and the guiding portion 46 of the base 32 are combined to form a circular channel, and a tunnel is form between the plate 44 of the box 30 and the guiding portion 46 of the base 32. The opening 40 of the box 30 and the gap 48 of the base 32 are aligned with each other.

The driving member 24 is a motor in the embodiment to be mounted on a back of the base 32. A housing 50 is mounted on the back of the base 32 covering the driving member 24. The driving member 24 has a shaft 52 passing through a hole at a center of the base 32.

The transporting member 26 is a disk-like member having several recesses on a circumference thereof. These recesses form ball carrying portions 54 of the transporting member 26. The transporting member 26, which is provided at an inner side of the base 32, has a hole at a center to be fitted to the shaft 52 of the driving member 24 that the transporting member 26 may be rotated with a center of rotation of the shaft 52. The ball carrying portions 54 are located at the circular channel of the container 22, and some ball carrying portions 54 are further located in the tunnel. The transporting member 26 has a fixing portion 56 thereon.

The asynchronous driving member 28 is a torsional spring in the embodiment having an end fixed to the fixing portion 56 on the transporting member 26 and the other end fixed to a nut 58 screwed onto the shaft 52 of the driving member 24. When the shaft 52 of the driving member 24 turns, it will drive the transporting member 26 through the asynchronous driving member 28. When an external force is exerted on the transporting member 26 to stop it rotating, the driving member 24 will turn the asynchronous driving member 28 only. At this moment, the asynchronous driving member 28 will store a torsional power. When the external force is gone, the asynchronous driving member 28 will release the torsional power to turn the transporting member 26. At this condition, the transporting member 26 is driven by the asynchronous driving member 28, and it will turn very fast until another external force is exerted on the transporting member 26 or the torsional power of the asynchronous driving member 28 is out.

Figure 3:
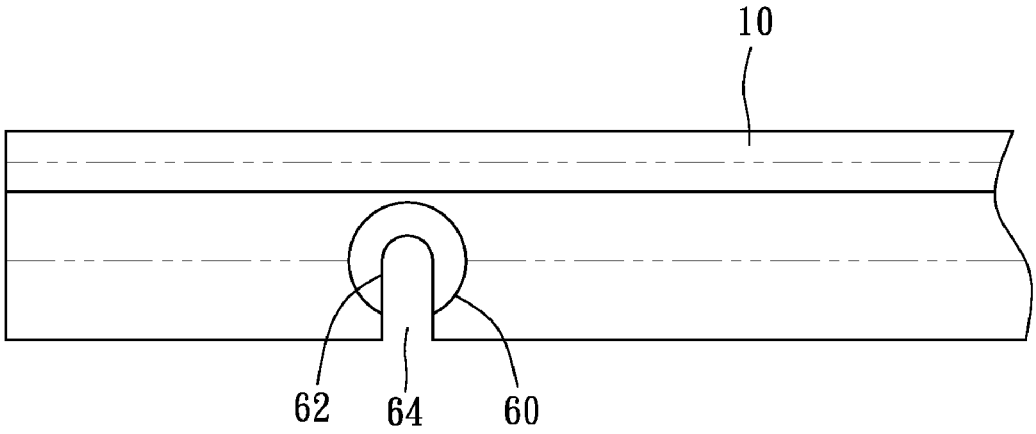
FIG. 3 is a front view of the frame of the paintball gun of the preferred embodiment of the present invention, showing the inlet and the outlet.

As shown in FIG. 3, the frame 10 is provided with two bores communicated with a chamber 66 therein. One bore is defined as an inlet 60, and the other bore is defined as an outlet 62. The frame 10 further has a gap 64 at a bottom between the inlet 60 and the outlet 62. The inlet 60 is greater than a paintball, and the outlet 62 is a narrow gap to allow the transporting member 26 passing only. The container 22 is fixed to the bottom of the frame 10 with the slot 38 engaged with the frame 10 and the barrel 12. The annular channel is aligned with the inlet 60 and the outlet 62 that the ball carrying portions 54 will enter the chamber 66 via the inlet 60, and leave it via the outlet 62.

Figure 5:
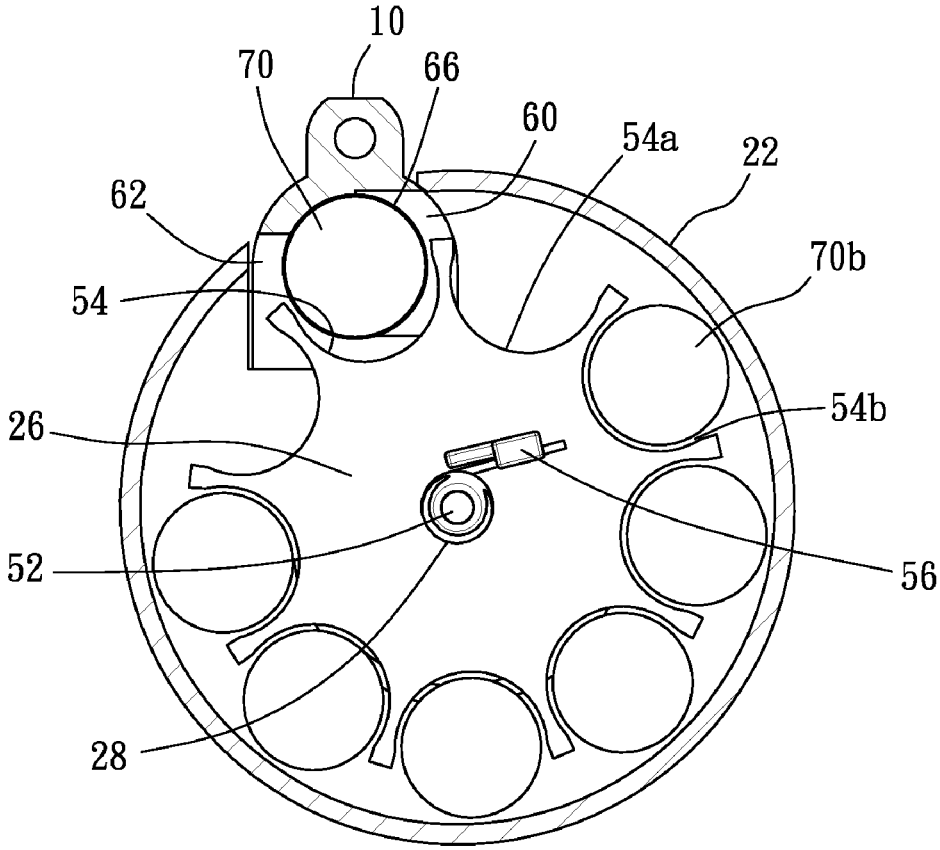
FIG. 5 is a sectional view along the 5-5 line of FIG. 4.
Figure 4:
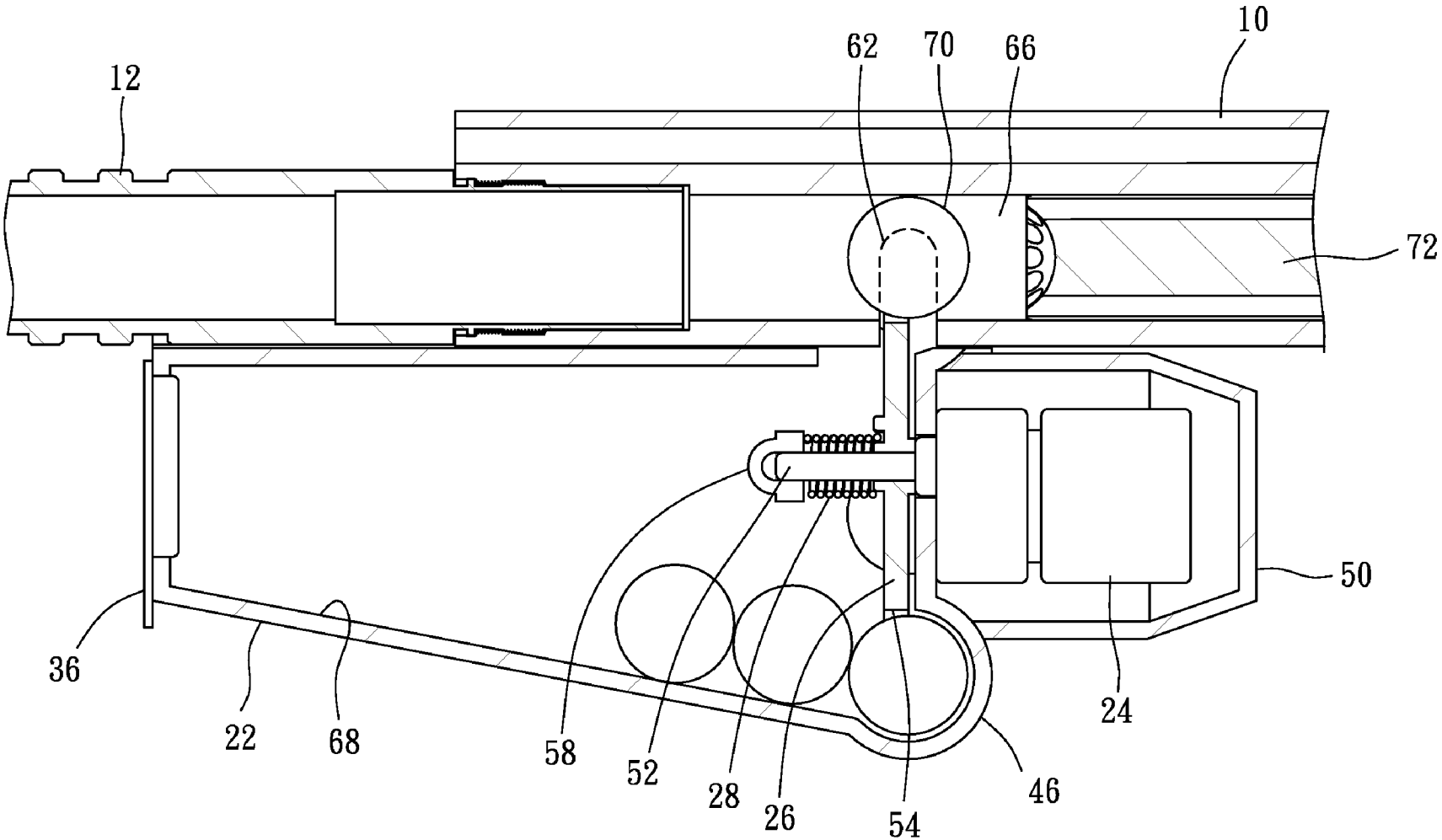
FIG. 4 is a sectional view of the preferred embodiment of the present invention, showing the piston at a ready position to fire a paintball.

As shown in FIG. 4, the container 22 is sloped downward from the front end to the rear end that is achieved by a slope 68 on a bottom of the box 30. Paintballs received in the container 22 will roll toward the transporting member 26 because of the gravity and are held by the exposed ball carrying portions 54 (those in the tunnel and in the chamber can not receive the paintball, but they are supposed to carry paintballs already). The paintballs held in the ball carrying portions 54 of the transporting member 26 will be transported into the chamber 66 in sequence when the transporting member 26 is turned. The paintball 70 in the chamber 66 is stopped therein because of the outlet 62 is too small for the paintball 70 that the transporting member 26 is stopped and waiting for firing the paintball 70, as shown in FIG. 5. During the time waiting for firing, the driving member 24 is still turning to turn the asynchronous driving member 28.

Figure 6:
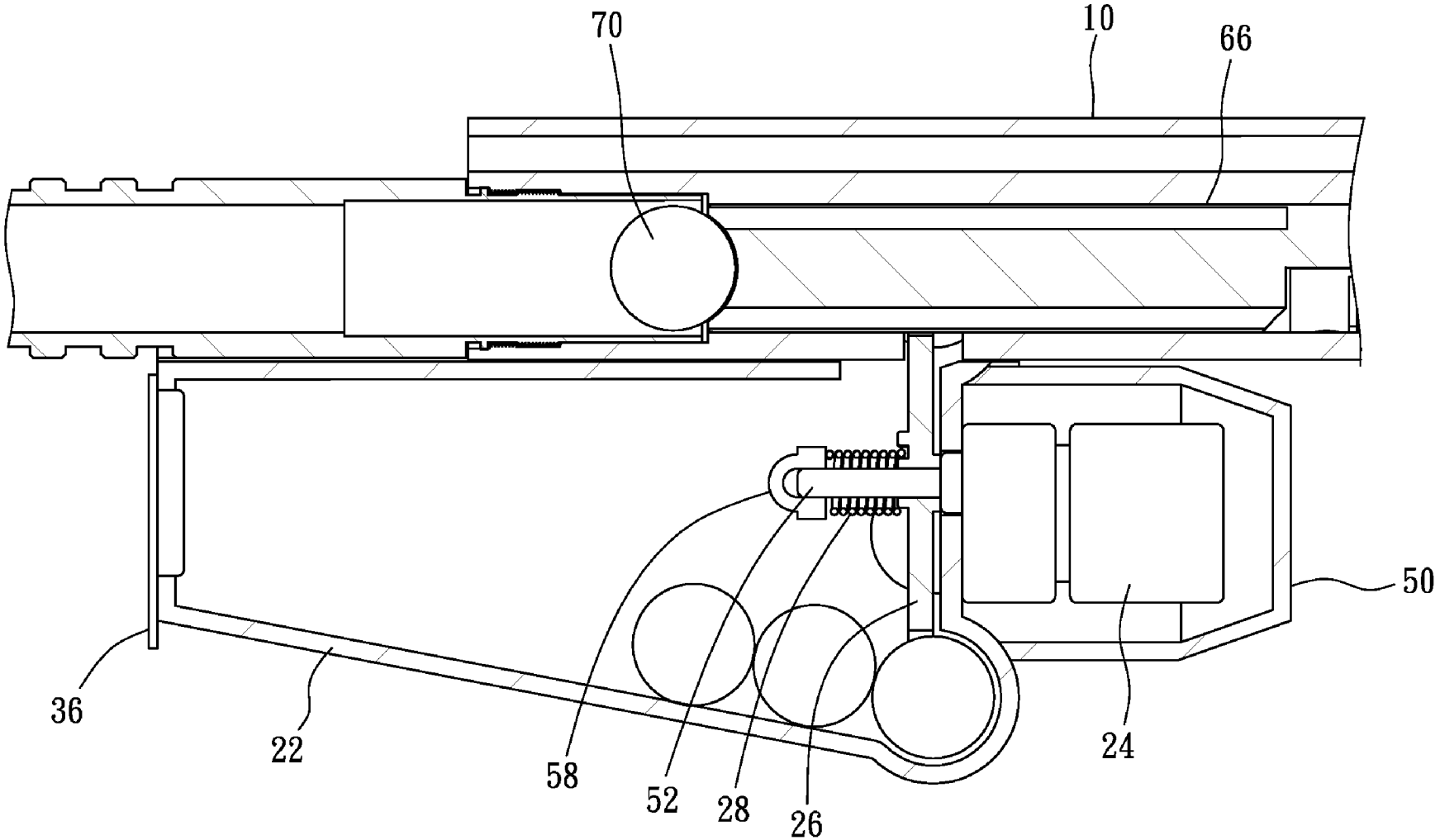
FIG. 6 is a sectional view of the preferred embodiment of the present invention, showing the piston firing the paintball.
Figure 7:
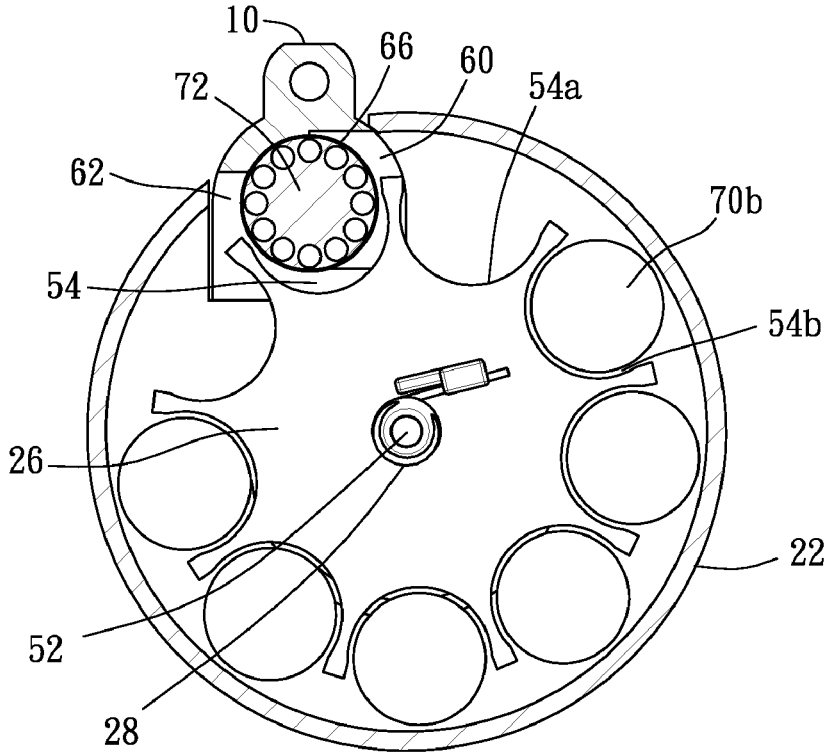
FIG. 7 is another sectional view of FIG. 6.

As shown in FIG. 6 and FIG. 7, when a shooter pulls the trigger 16, a piston 72 is moving forward to fire the paintball 70 in the chamber 66. After that, the piston 72 will return to the position as shown in FIG. 4 quickly. At this moment, the chamber 66 is empty, which means there is no paintball in the chamber 66 and the transporting member 26 is free to rotate again, so that the asynchronous driving member 28 will release its torsional power to turn the transporting member 26 for sending another paintball into the chamber 66. The transporting member 26 will stop when a paintball enters the chamber 66 and is stopped therein waiting for firing.

Figure 8:
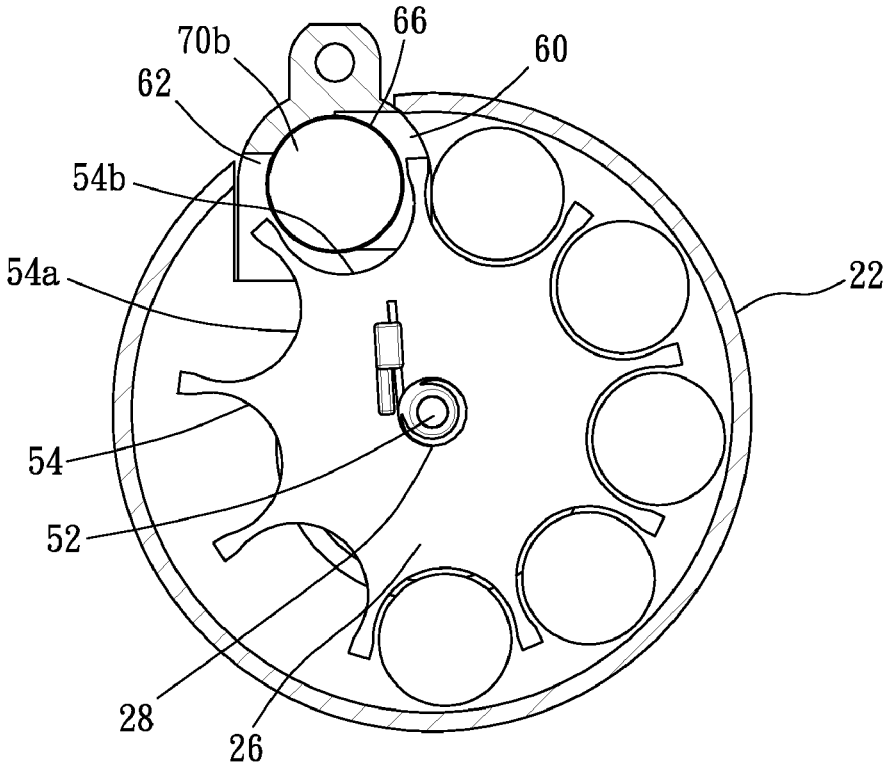
FIG. 8 is a sectional view following FIG. 7, showing the action of the asynchronous driving member.
Figure 9:
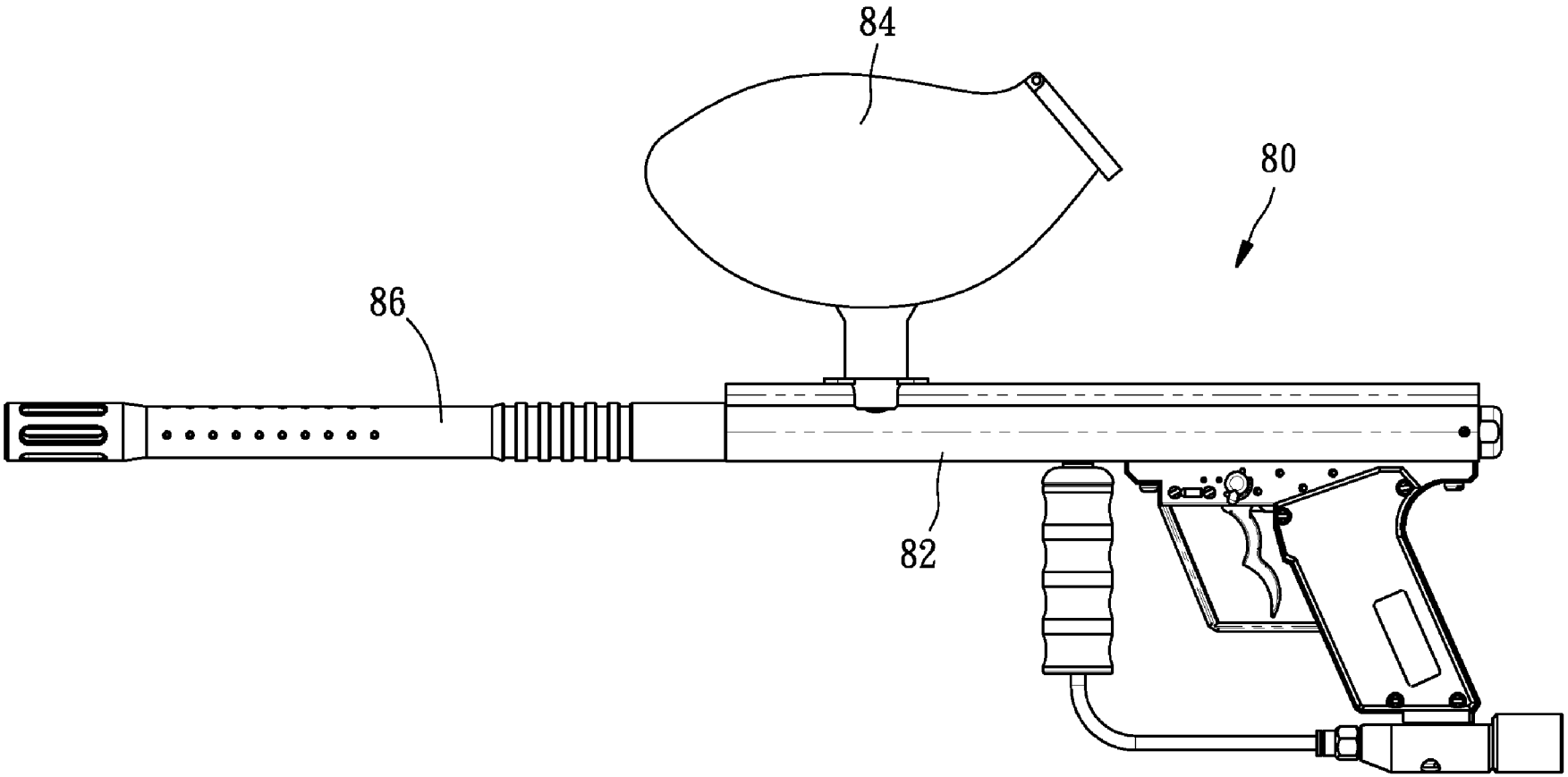
FIG. 9 PRIOR ART
FIG. 9 is a front view of the conventional paintball gun.

When the paintball 70 in the ball carrying portion is fired, and the next ball carrying portion 54*a* has no paintball therein, the asynchronous driving member 28 will turn the transporting member 26 very fast until the ball carrying portion 54*b* held with a paintball 70*b* being sent into the chamber 66 and being stopped therein, as shown in FIG. 8.

In conclusion, the present invention provides the transporting member actively sending the paintball into the chamber for firing that gravity is not the only reason for sending paintball, so that the paintball feeding device of the present invention may be mounted at any position of the gun. As a result, the paintball gun of the present invention is clear at a top of the frame so that it will has no drawback of the conventional paintball gun with a huge hopper on the top thereof. In the real shooting test of the present invention, the paintball gun of the present invention may shoot every direction's targets except for the target too low or the gun tilting to the right over a predetermined degree.

What is claimed is:

1. A paintball feeding device of a paintball gun, comprising:

a container, in which paintballs are received, mounted on the paintball gun;

a transporting member, which is received in the container, including a plurality of ball carrying portions to hold the paintballs;

wherein the paintball gun has a frame with a chamber therein, and the frame is provided with an inlet and an outlet on opposite sides thereof to be communicated with the chamber respectively;

a driving member for driving the transporting member to have the ball carrying portions entering the chamber via the inlet in sequence and leaving the chamber via the outlet; and where the frame inlet has a larger diameter than either the ball carrying portions or the paintball, and the frame outlet has a diameter that is smaller than the paintball but is greater in diameter than the ball carrying portions and the paintball received in the ball carrying portion enters the chamber via the inlet and is stopped in the chamber, thus stopping the transporting member, and only the ball carrying portion leaves the chamber via the outlet after the paintball is shot such that the transporting member rotates again to convey the next paintball into the ball carrying portion and into the chamber via the inlet.

2. The paintball feeding device of the paintball gun as defined in claim 1, wherein the transporting member is a disk-like member having recesses on a circumference to be the ball carrying portions, and the driving member is a motor driving the transporting member rotating.

3. The paintball feeding device of the paintball gun as defined in claim 1, wherein the container has a slope sloping toward the transporting member.

4. The paintball feeding device of the paintball gun as defined in claim 1, wherein the container covers both of the inlet and the outlet.

5. The paintball feeding device of the paintball gun as defined in claim 1, wherein the container has a guiding portion, which is complementary to the paintballs, to form a channel that the ball carrying portions of the transporting member travels along the channel.

6. The paintball feeding device of the paintball gun as defined in claim 5, wherein the container is provided with a plate to be combined with the guiding portion to form a tunnel therebetween, and the ball carrying portions of the transporting member go into the tunnel in sequence.

7. The paintball feeding device of the paintball gun as defined in claim 1, wherein the container has a slot complementary to the frame.

8. The paintball feeding device of the paintball gun as defined in claim 1, wherein the container is mounted at a bottom of the frame of the paintball gun.

9. The paintball feeding device of the paintball gun as defined in claim 1, further comprising an asynchronous driving member between the driving member and the transporting member, wherein the asynchronous driving member is driven by the driving member and store a power from the driving member when the transporting member is stopped by an external force, and the asynchronous driving member releases the power stored therein to drive the transporting member moving when the external force is gone.

10. The paintball feeding device of the paintball gun as defined in claim 9, wherein the asynchronous driving member is a torsional spring with opposite ends connected to the driving member and the transporting member respectively.

* * * * *